US005409414A

United States Patent [19]

Sheang

[11] Patent Number: 5,409,414

[45] Date of Patent: Apr. 25, 1995

[54] TOY SPHERE

[76] Inventor: Liaw R. Sheang, P.O. Box 82-144, Taipei, Taiwan, Prov. of China

[21] Appl. No.: 123,924

[22] Filed: Sep. 20, 1993

[51] Int. Cl.[6] ..... A63H 29/00

[52] U.S. Cl. ..... 446/458; 446/443

[58] Field of Search ..... 446/458, 456, 462, 437, 446/443

[56] References Cited

U.S. PATENT DOCUMENTS

| | | | |
|---|---|---|---|
| 2,535,396 | 12/1950 | Dube | 446/458 X |
| 3,798,835 | 3/1974 | McKeehan | 446/458 X |
| 4,601,675 | 7/1986 | Robinson | 446/458 X |

*Primary Examiner*—Mickey Yu

*Attorney, Agent, or Firm*—Alfred Lei

[57] ABSTRACT

This invention relates to a toy sphere and in particular to one including an annular member provided with a circular groove at both sides, a plurality of internal gear teeth at an inner surface, and two opposite eccentric pins at an outer surface, a power seat threadedly engaged with the internal gear teeth of the annular member and having a motor electrically connected with batteries, an upper hemispherical housing having internal threads, a lower hemispherical housing having external threads engageable with the internal threads of the upper hemispherical and having two aligned holes engaged with the two opposite eccentric pins of the annular member.

1 Claim, 8 Drawing Sheets

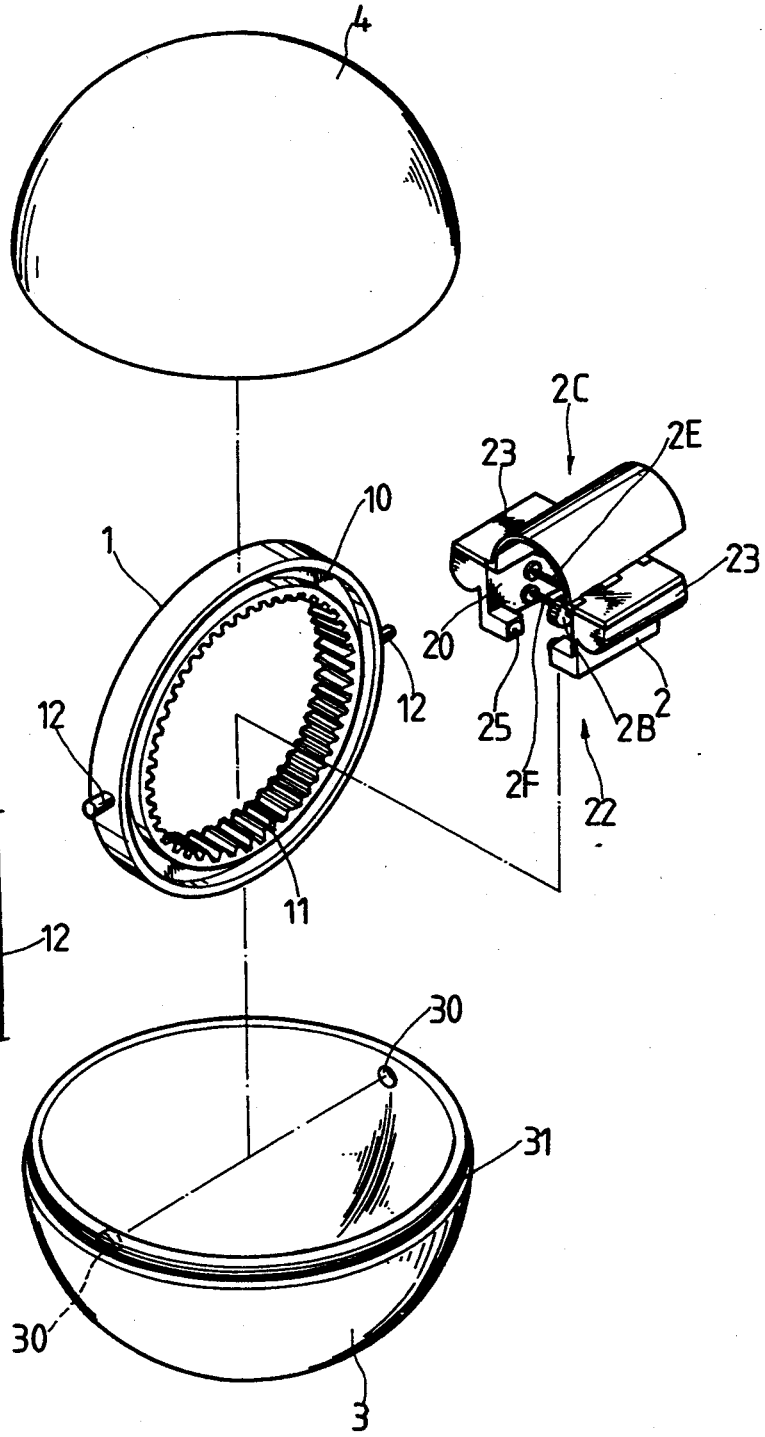
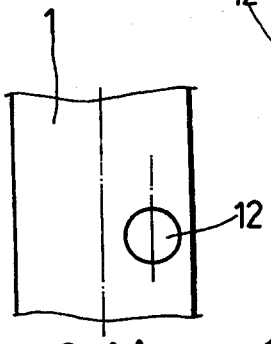
FIG. 1A
FIG. 1

TOY SPHERE

BACKGROUND OF THE INVENTION

It has been found that the conventional toy ball is simply a sphere which remains standstill when no external force is applied thereto hence making it monotonous and uninteresting.

Therefore, it is an object of the present invention to provide an improved toy sphere which may go by itself.

SUMMARY OF THE INVENTION

This invention relates to a toy sphere.

It is the primary object of the present invention to provide a toy sphere which can automatically rotate by itself.

It is another object of the present invention to provide a toy sphere which can automatically turn over when meeting with an obstacle.

It is still another object of the present invention to provide a toy sphere which is an interesting and attractive.

It is still another object of the present invention to provide a toy sphere which is simple in construction.

It is a further object of the present invention to provide a toy sphere which is easy to manufacture.

Other objects and merits and a fuller understanding of the present invention will be obtained by those having ordinary skill in the art when the following detailed description of the preferred embodiment is read in conjunction with the accompanying drawings wherein like numerals refer to like or similar parts.

BRIEF DESCRIPTION OF THE DRAWINGS

FIG. 1 is an exploded view of the present invention;

FIG. 1A is an enlarged fragmentary view of the present invention;

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 2B:
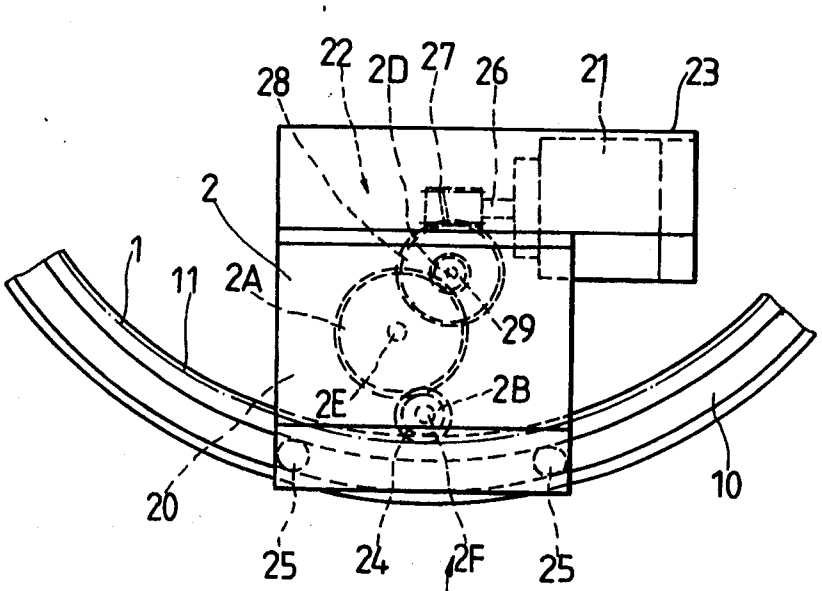
FIG. 2B is a side view of the power seat.
Figure 2A:
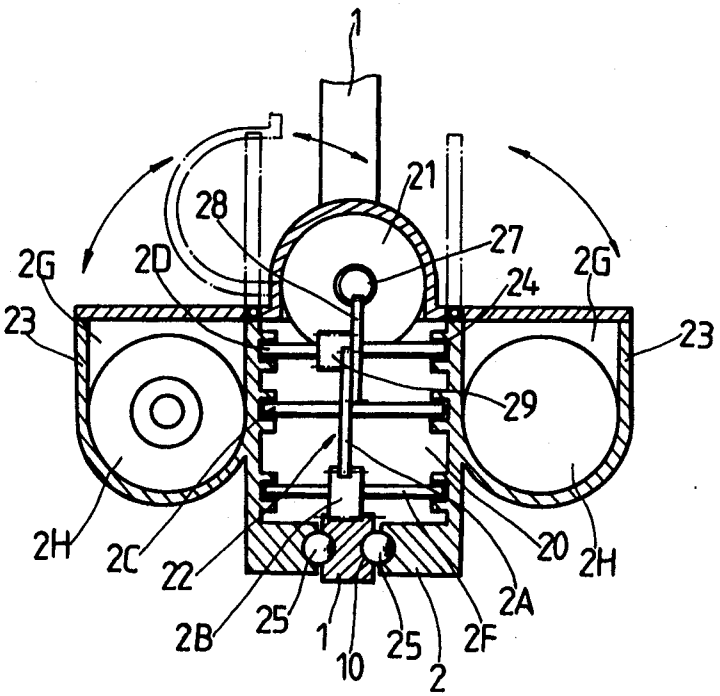
FIG. 2A is a sectional view of the power seat.
Figure 3:
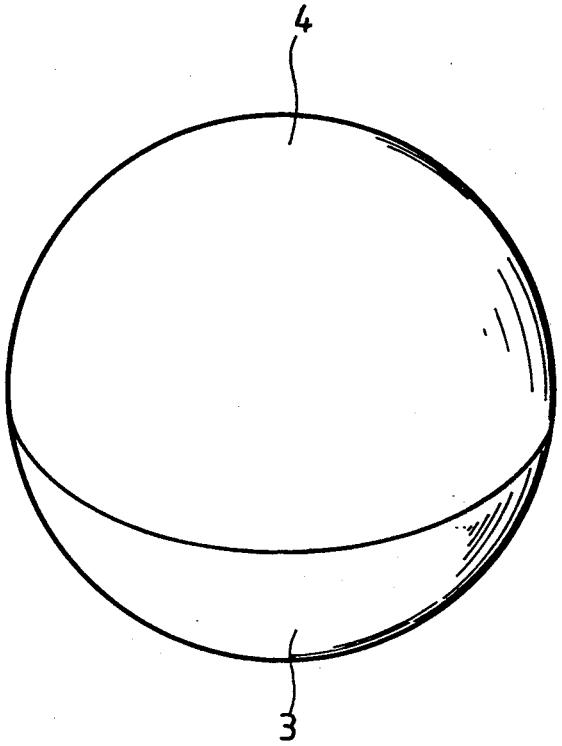
FIG. 3 is a perspective view of the present invention.
Figure 4:
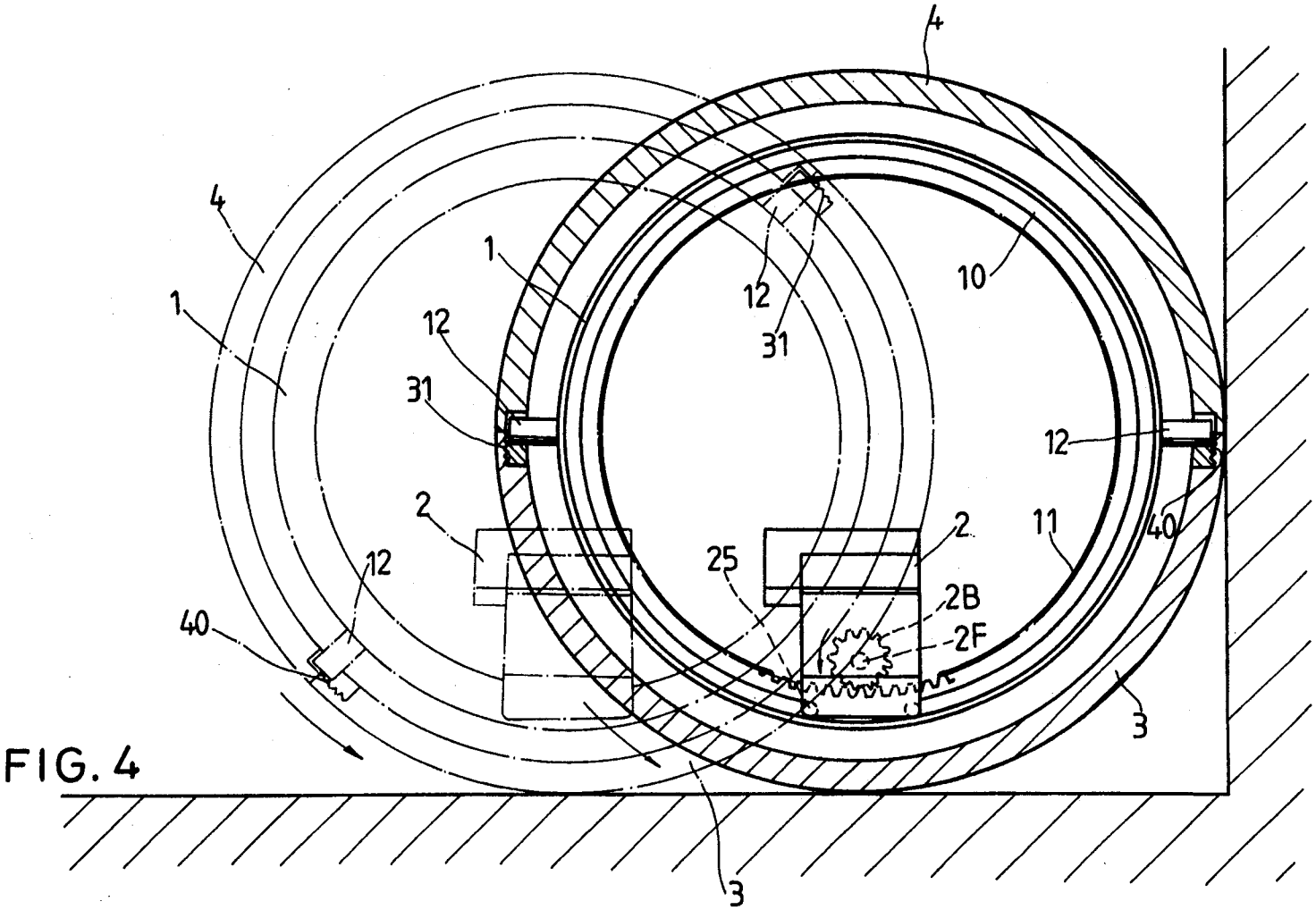
FIGS. 4 and 5 and show that the present invention meets with a block.
Figure 5:
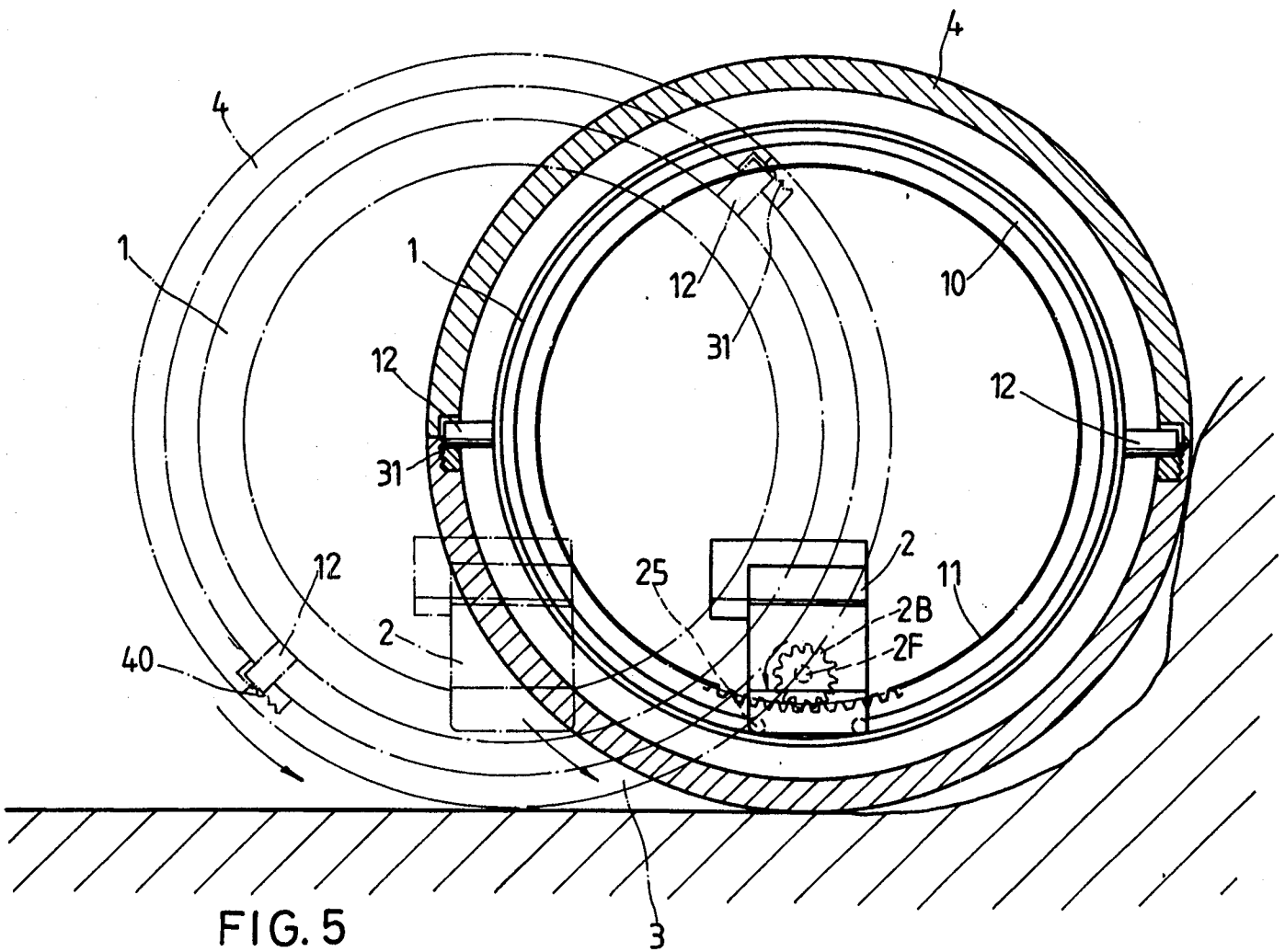
Figure 6:
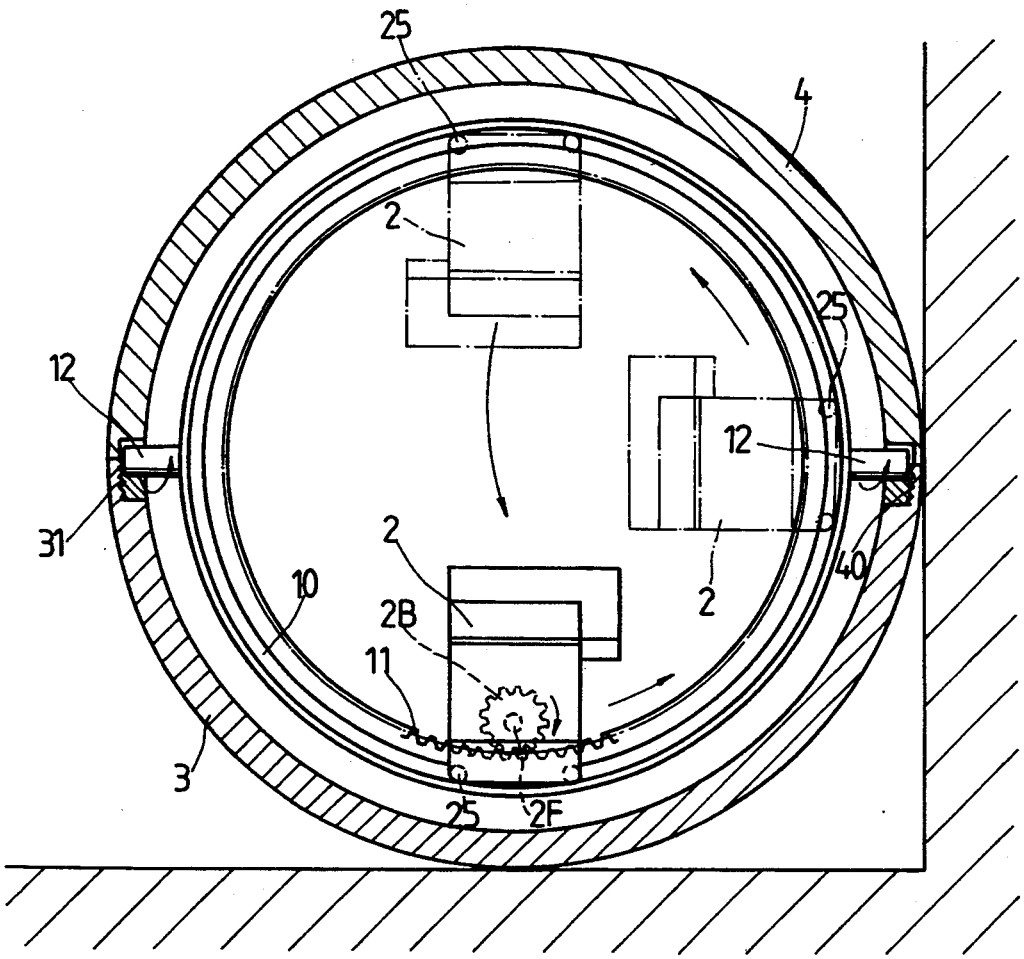
FIG. 6 shows the lift of the power seat.
Figure 7:
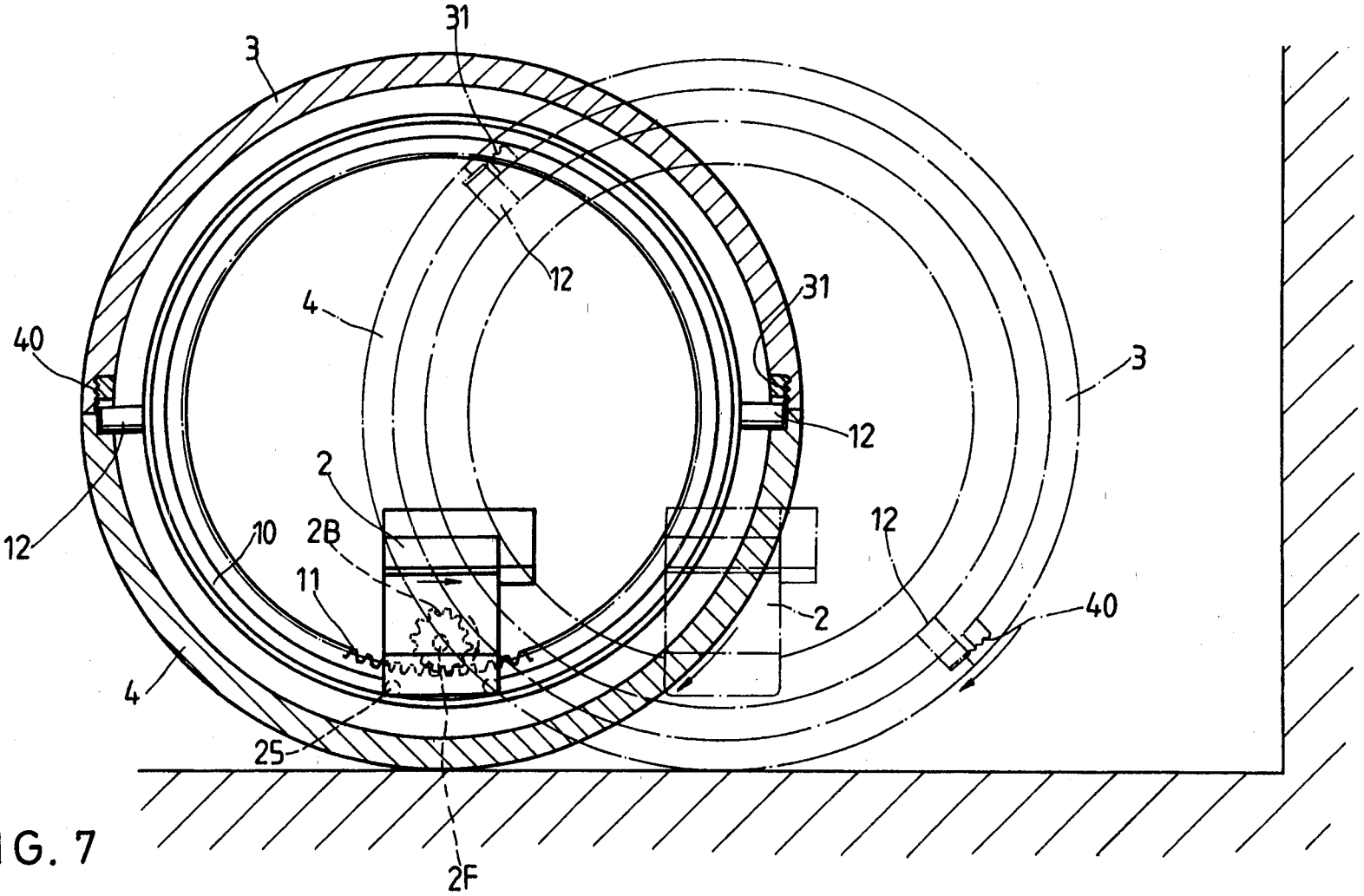
FIG. 7 shows the way how the present invention is turned over when meeting an obstacle.
Figure 8A:
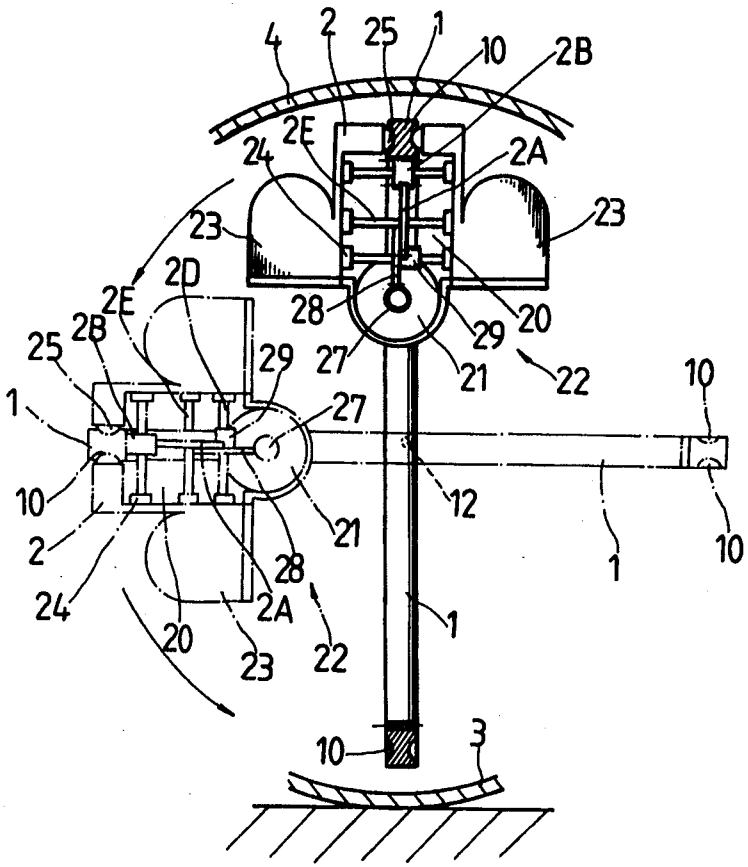
FIGS. 8A and 8B shows the working principle of the present invention.
Figure 8B:
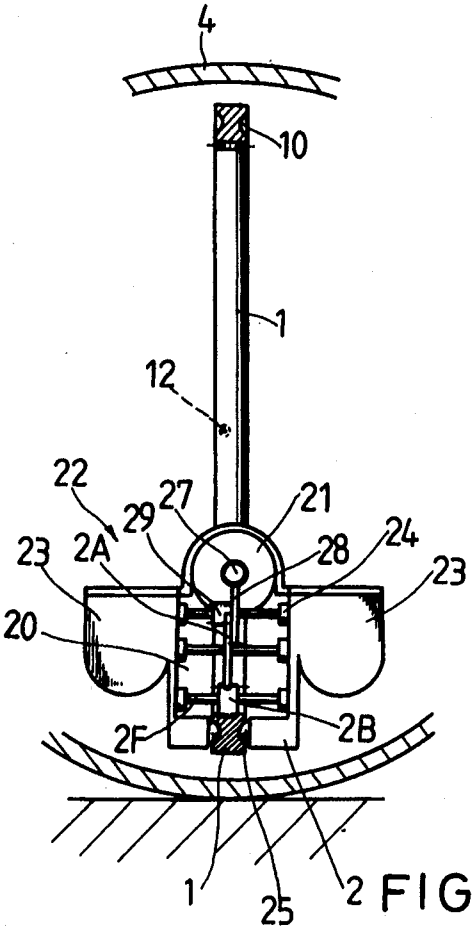

With reference to the drawings and in particular to FIGS. 1 through 3 thereof, the toy sphere according to the present invention mainly comprises an annular member 1, a power seat 2, a lower hemispherical housing 3, and an upper hemispherical housing 4.

The annular member 1 is provided with a circular groove 10 at both sides, a plurality of internal gear teeth 11 at the inner surface, and two opposite eccentric pins 12 at the outer surface (see FIG. 1A).

The power seat 2 is formed with a central chamber for receiving a motor 21 and a reduction gear 22, two side chambers 2G in each of which is mounted a battery casing 23 for receiving a battery 2H, a plurality of axle seats 24 for supporting gear axle assembly 2C, and two rollers 25 engaged between the power seat 2 and the grooves 10 of the annular member 1. Further, the motor 21 is provided with an axle 26 on which is fixedly mounted a worm 27. The worm 27 is engaged with the reduction gear 22 which is composed of a first gear 28, a second gear 29, a third gear 2A, and a driving gear 2B. The first gear 28 is meshed with the worm 27, while the driving gear 2B is engaged with the internal gear teeth 11 of the annular member 1. The gear axle assembly 2C is composed of a first axle 2D, a second axle 2E, and a third axle 2F which are connected with the first gear 28, the second gear 29, and the third gear 2A and the driving gear 2B, respectively. Hence, the power produced by the motor 21 can be transmitted to the annular member 1.

The lower hemispherical housing 3 is formed with two aligned holes 30 for engaging with the eccentric pins 12 of the annular member 1 and external threads 31 on its upper edge.

The upper hemispherical housing 4 is provided with internal threads (not shown) engageable with external threads 31 of the lower hemispherical housing 3.

When in assembly, the power seat 2 is first mounted into the annular member 1 so that the driving gear 2B of the reduction gear 22 is engaged with the internal gear teeth 11 of the annular member 1 and the rollers 25 are kept between the power seat 2 and the grooves 10 of the annular member 1. Then, the annular member 1 together with the power seat 2 is disposed within the lower hemispherical housing 3 so that the eccentric pins 12 of the annular member 1 are engaged with the holes 30 of the lower hemispherical housing 3. Thereafter, the upper hemispherical housing 4 is threadedly engaged with the lower hemispherical housing 3.

When in use (see FIGS. 4 through 8), the upper hemispherical housing 4 is disengaged from the lower hemispherical housing 3 and a battery 2H is inserted into each battery casing 23. As the motor 21 is turned on, the upper hemispherical housing 4 is engaged with the lower hemispherical housing 3. Then, the motor 21 will rotate axle 26 which will in turn drive the worm 27. The worm 27 will in turn drive the driving gear 2B via the reduction gear 22. Thereafter, the driving gear 2B will drive the annular member 1 to rotate thereby rotating the toy sphere via the pin 12. As the toy sphere meets with an obstacle (see FIGS. 4, 5, 6 and 7), the toy sphere will be stopped and the power seat 2 will rotate along the internal gear teeth 11 of the annular member 1 to the uppermost position. Then, by means of the gravitational force and the weight of the power seat 2, the annular member 1 will be turned over thus causing the toy sphere to go in other direction.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A toy sphere comprising:

an annular member having two planar sides provided with a circular groove at each of said sides, a plurality of internal gear teeth at an inner surface, and two opposite eccentric pins at an outer surface, said pins aligned in an axis spaced away and parallel from a center plane passing through said annular member and between said planar sides;

a power seat having at least one driven gear engaged with the internal gear teeth of said annular member and having a motor electrically connected with batteries;

an upper hemispherical housing having internal threads; and a lower hemispherical housing having external threads engageable with the internal threads of said upper hemispherical housing and having two aligned holes rotatably engaged with the two opposite eccentric pins of said annular member.

* * * * *